US009091116B2

(12) United States Patent
Saunders et al.

(10) Patent No.: US 9,091,116 B2
(45) Date of Patent: Jul. 28, 2015

(54) WINDOW MULL SYSTEM

(75) Inventors: Melvin Saunders, Auburn, WA (US); Chris Roderick, Gig Harbor, WA (US); Michael Kuneman, Auburn, WA (US)

(73) Assignee: Milgard Manufacturing Incorporated, Tacoma, WA (US)

( * ) Notice: Subject to any disclaimer, the term of this patent is extended or adjusted under 35 U.S.C. 154(b) by 0 days.

(21) Appl. No.: 13/704,491

(22) PCT Filed: Jun. 3, 2011

(86) PCT No.: PCT/US2011/039137

§ 371 (c)(1), (2), (4) Date: Apr. 25, 2013

(87) PCT Pub. No.: WO2011/153479

PCT Pub. Date: Dec. 8, 2011

(65) Prior Publication Data

US 2013/0212973 A1 Aug. 22, 2013

Related U.S. Application Data

(60) Provisional application No. 61/351,771, filed on Jun. 4, 2010.

(51) Int. Cl.
*E06B 1/36* (2006.01)
*E06B 1/60* (2006.01)

(52) U.S. Cl.
CPC ..... *E06B 1/366* (2013.01); *E06B 1/6007* (2013.01)

(58) Field of Classification Search
CPC ..... E06B 1/366; E06B 1/6007
USPC ..... 52/204.1, 204.5, 206, 213, 235, 282.1, 52/656.2, 656.5, 656.6, 656.9; 49/365, 49/504
See application file for complete search history.

(56) References Cited

U.S. PATENT DOCUMENTS

| | | | | | |
|---|---|---|---|---|---|
| 3,471,985 | A | * | 10/1969 | Lindelow | 52/204.591 |
| 3,604,739 | A | * | 9/1971 | Carlisle | 403/294 |
| 4,292,771 | A | * | 10/1981 | Ellis | 52/98 |
| 4,355,676 | A | * | 10/1982 | Lee | 160/107 |
| 4,390,578 | A | * | 6/1983 | Brooks | 428/57 |
| 4,606,162 | A | * | 8/1986 | Wendt | 52/282.4 |
| 4,650,702 | A | * | 3/1987 | Whitmyer | 428/31 |
| 4,663,896 | A | * | 5/1987 | Dunnick | 52/71 |

(Continued)

FOREIGN PATENT DOCUMENTS

| | | | |
|---|---|---|---|
| DE | 3929557 C2 | * | 4/1993 |
| FR | 2114276 AS | * | 6/1972 |

(Continued)

*Primary Examiner* — Rodney Mintz
(74) *Attorney, Agent, or Firm* — Rathe Lindenbaum LLP

(57) ABSTRACT

A mull binder system includes a mull binder that couples a first and second window frame and provides a seal along the grooves. The first window frame has an exterior side, an opposing interior side and at least a first side and a second side extending perpendicular to the exterior side and interior side, the first side including a groove therein. A second window frame has an exterior side, an opposing interior side and a first side and a second side extending perpendicular to the exterior side and interior side, the second side including a groove therein. The mull binder has a first and second arm coupled thereto. Each arm has a plurality of flexible barbs extending therefrom. The barbs on the first arm and second arm are received within the groove of the first window frame and second window frame respectively.

20 Claims, 6 Drawing Sheets

(56) References Cited

U.S. PATENT DOCUMENTS

| | | | | |
|---|---|---|---|---|
| 4,934,115 | A * | 6/1990 | Nozaki | 52/71 |
| 5,007,221 | A * | 4/1991 | Matthews et al. | 52/464 |
| 5,133,108 | A * | 7/1992 | Esnault | 16/225 |
| 5,408,784 | A * | 4/1995 | Wruck et al. | 49/489.1 |
| 5,481,839 | A * | 1/1996 | Lang et al. | 52/235 |
| 5,515,652 | A * | 5/1996 | Klimek | 49/501 |
| 5,540,019 | A * | 7/1996 | Beske et al. | 52/204.5 |
| 5,560,155 | A * | 10/1996 | Back | 52/90.1 |
| 5,622,017 | A * | 4/1997 | Lynn et al. | 52/209 |
| 5,644,878 | A * | 7/1997 | Wehrmann | 52/287.1 |
| 5,687,519 | A * | 11/1997 | Bruchu | 52/213 |
| 5,832,681 | A * | 11/1998 | Johnson | 52/210 |
| 6,205,724 | B1 * | 3/2001 | Garling et al. | 52/209 |
| 6,360,498 | B1 * | 3/2002 | Westphal | 52/204.5 |
| 6,378,253 | B1 * | 4/2002 | Richardson | 52/204.5 |
| 6,467,226 | B2 * | 10/2002 | Dodson et al. | 52/220.1 |
| 6,523,311 | B2 * | 2/2003 | Edger | 52/204.593 |
| 6,662,512 | B2 * | 12/2003 | Westphal | 52/204.5 |
| 6,722,089 | B2 * | 4/2004 | Budzinski | 52/204.5 |
| 6,843,025 | B2 * | 1/2005 | Paz | 52/79.1 |
| 7,080,488 | B2 * | 7/2006 | Hocker et al. | 52/235 |
| 7,162,842 | B2 * | 1/2007 | Ribic | 52/235 |
| 7,168,213 | B2 * | 1/2007 | Rudduck et al. | 52/235 |
| D565,199 | S * | 3/2008 | Westphal | D25/122 |
| 7,434,364 | B2 * | 10/2008 | MacDermott et al. | 52/584.1 |
| 7,481,028 | B2 * | 1/2009 | Tufts et al. | 52/214 |
| 7,596,912 | B2 * | 10/2009 | Ito et al. | 52/204.5 |
| 8,061,103 | B2 * | 11/2011 | McMahon | 52/582.2 |
| 8,245,462 | B2 * | 8/2012 | Miethe et al. | 52/204.7 |
| 8,266,851 | B2 * | 9/2012 | Campbell et al. | 52/204.5 |
| 8,464,480 | B2 * | 6/2013 | Libby et al. | 52/204.7 |
| 8,584,426 | B2 * | 11/2013 | Valler et al. | 52/656.5 |
| 8,904,720 | B2 * | 12/2014 | Woodward et al. | 52/204.66 |
| 2001/0015027 | A1 * | 8/2001 | Nurcombe | 40/700 |
| 2001/0017011 | A1 * | 8/2001 | Richardson | 52/90.1 |
| 2001/0029708 | A1 * | 10/2001 | Richardson | 52/57 |
| 2002/0059758 | A1 * | 5/2002 | Dodson et al. | 52/204.1 |
| 2002/0092248 | A1 * | 7/2002 | Westphal | 52/204.5 |
| 2003/0126812 | A1 * | 7/2003 | Folsom et al. | 52/204.62 |
| 2003/0217523 | A1 * | 11/2003 | Budzinski | 52/204.5 |
| 2004/0031220 | A1 * | 2/2004 | Hocker et al. | 52/235 |
| 2004/0055238 | A1 * | 3/2004 | Whiting | 52/461 |
| 2004/0159057 | A1 * | 8/2004 | Hornung | 52/204.5 |
| 2006/0029463 | A1 * | 2/2006 | Schultz et al. | 403/187 |
| 2006/0080917 | A1 * | 4/2006 | Hall et al. | 52/235 |
| 2007/0011960 | A1 * | 1/2007 | Richardson | 52/200 |
| 2007/0137124 | A1 * | 6/2007 | MacDermott et al. | 52/278 |
| 2008/0010919 | A1 * | 1/2008 | Tufts et al. | 52/204.591 |
| 2008/0016800 | A1 * | 1/2008 | Tufts et al. | 52/204.6 |
| 2008/0092463 | A1 * | 4/2008 | Poirier et al. | 52/204.5 |
| 2008/0168724 | A1 * | 7/2008 | Spannbauer et al. | 52/235 |
| 2008/0216424 | A1 * | 9/2008 | Westphal et al. | 52/204.5 |
| 2009/0000225 | A1 * | 1/2009 | Ito et al. | 52/204.5 |
| 2009/0094923 | A1 * | 4/2009 | Weir et al. | 52/506.01 |
| 2009/0293387 | A1 * | 12/2009 | Miethe et al. | 52/204.62 |
| 2009/0313921 | A1 * | 12/2009 | Poirier | 52/204.5 |
| 2010/0011687 | A1 * | 1/2010 | Arias | 52/235 |
| 2010/0192488 | A1 * | 8/2010 | Campbell et al. | 52/209 |
| 2011/0113706 | A1 * | 5/2011 | Krause | 52/204.5 |
| 2011/0296776 | A1 * | 12/2011 | Valler et al. | 52/204.6 |
| 2012/0240492 | A1 * | 9/2012 | Woodward et al. | 52/204.5 |
| 2012/0279136 | A1 * | 11/2012 | Miethe et al. | 49/404 |
| 2012/0297690 | A1 * | 11/2012 | Roberts | 49/504 |
| 2013/0291459 | A1 * | 11/2013 | Frey | 52/204.591 |
| 2014/0053479 | A1 * | 2/2014 | Valler et al. | 52/204.5 |
| 2014/0331577 | A1 * | 11/2014 | Libby et al. | 52/204.61 |
| 2015/0020465 | A1 * | 1/2015 | Saunders et al. | 52/204.6 |

FOREIGN PATENT DOCUMENTS

| | | | |
|---|---|---|---|
| WO | WO 2005121484 | A1 * | 12/2005 |
| WO | WO 2006120384 | A1 * | 11/2006 |

* cited by examiner

WINDOW MULL SYSTEM

CROSS-REFERENCE TO RELATED PATENT APPLICATIONS

The present application claims the benefit of U.S. Provisional Patent Application No. 61/351,771, filed Jun. 4, 2010, the disclosure of which is incorporated by reference herein in its entirety.

BACKGROUND OF THE INVENTION

The present invention relates generally to the field of systems to mull windows together.

Individual windows are mulled together to form a larger window unit. The larger window unit needs to provide sufficient strength for proper installation and operation of the individual windows. Variation in the design dimensions of the individual windows provide a challenge to proper installation and achieving a weather tight seal. It would be desirable to provide a window mulling system that would provide ease of installation as well as provide a weather tight seal between the mulled windows.

SUMMARY OF THE INVENTION

One embodiment relates to a mull binder system includes a first window frame having an exterior side, an opposing interior side and at least a first side and a second side extending perpendicular to the exterior side and interior side, the first side including a groove therein. A second window frame has an exterior side, an opposing interior side and a first side and a second side extending perpendicular to the exterior side and interior side, the second side including a groove therein. A mull binder has a first and second arm pivotally coupled thereto. Each arm has a plurality of flexible barbs extending therefrom. The barbs on the first arm are received within the groove of the first window frame and the barbs on the second arm are received within the groove of the second window frame thereby coupling the first window frame to the second window frame and providing a seal along the grooves. The exterior sides of the first window frame and exterior side of the second window frame are substantially co-planar.

Another embodiment of a mull binder system includes a first window frame having a top side, a bottom side, a right side, a left side, an exterior side and an interior side, the right side including a groove therein. The groove extends the majority of the distance between the top side and bottom side, the groove having a longitudinal axis perpendicular to the top side and bottom side and substantially parallel to the exterior and interior sides. A second window frame has a top side, a bottom side, a right side, a left side, an exterior side and an interior side, the left side including a groove therein. The groove extending the majority of the distance between the top side and bottom side, the groove having a longitudinal axis perpendicular to the top side and bottom side and substantially parallel to the exterior and interior sides. An exterior mull binder includes a first and second arm pivotally coupled thereto, each arm having a plurality of flexible barbs. The barbs on the first arm being received within the groove of the first window frame, the barbs on the second arm being received within the groove of the second window frame coupling the first window frame to the second window frame and providing a weather tight seal along the grooves.

In a further embodiment an exterior mull binder for coupling a first window frame and a second window frame comprises a binder having a first arm and a second arm. The first arm is pivotally coupled to the second arm. The first arm is movable relative to the second arm from a first installation position to a second in-use position. The first and second arms include a plurality of flexible barbs configured to be received within a groove of the first window frame and a groove of the second window frame respectively. The barbs couple the first window frame and second window frame together and provide a seal between the first window frame and second window frame. The first window frame is movable relative to the second window frame after the first arm is coupled to the first window frame and the second arm is coupled to the second window frame.

DETAILED DESCRIPTION OF THE PREFERRED EMBODIMENTS

Figure 1:
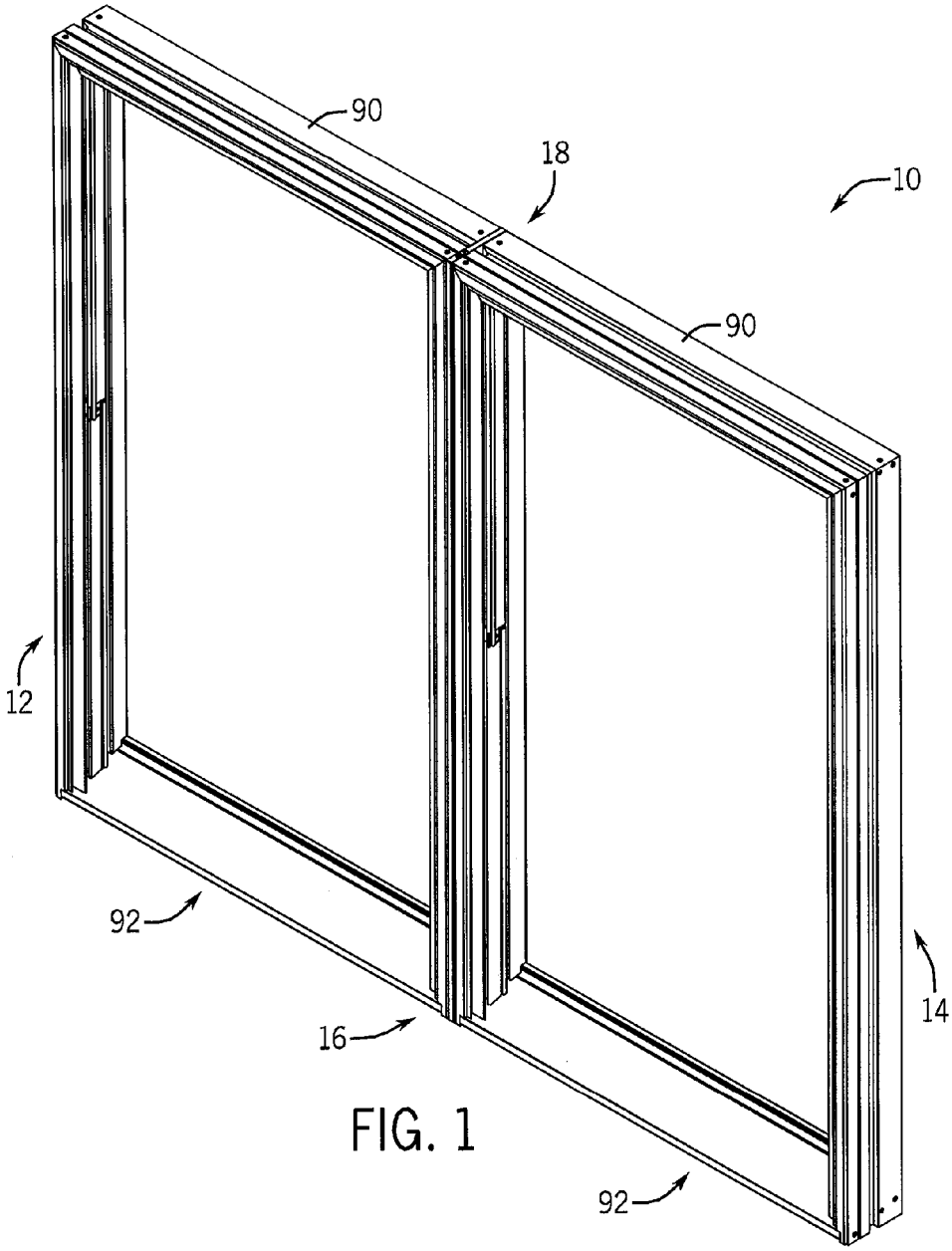
FIG. 1 is an isometric view of mulled windows.

Referring to FIG. 1, a mulled window 10 includes a first frame 12 and a second frame 14. For purposes of this application the term exterior will refer to the direction toward the outside of an enclosure, while the term interior" will refer to the direction toward the inside of an enclosure. The mulled window 10 separates an exterior of an enclosure from an interior of the enclosure. The mulled window 10 includes an exterior side 16 and an opposing interior side 18.

Figure 2:
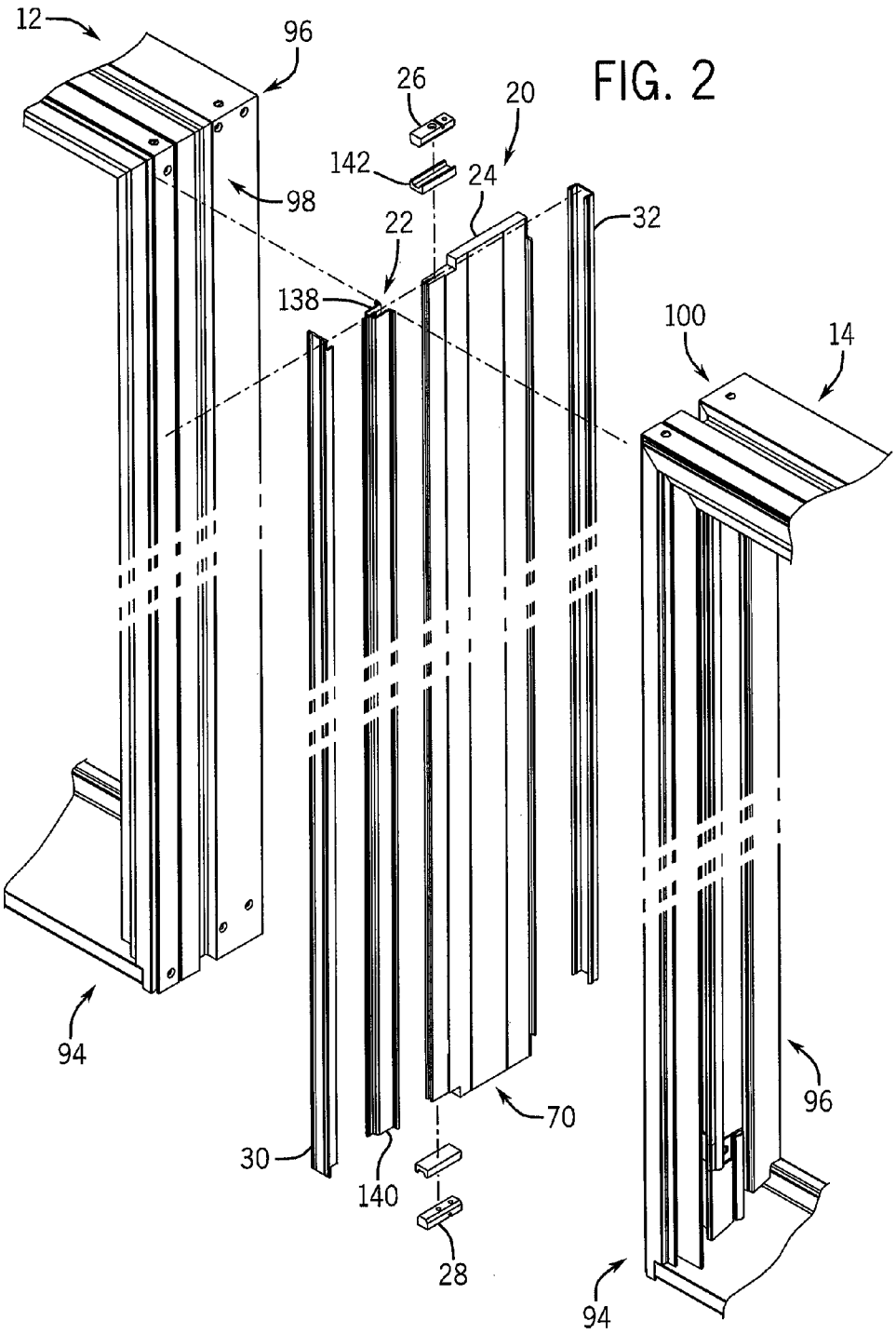
FIG. 2 is an exploded isometric view of a window mull system.
Figure 3:
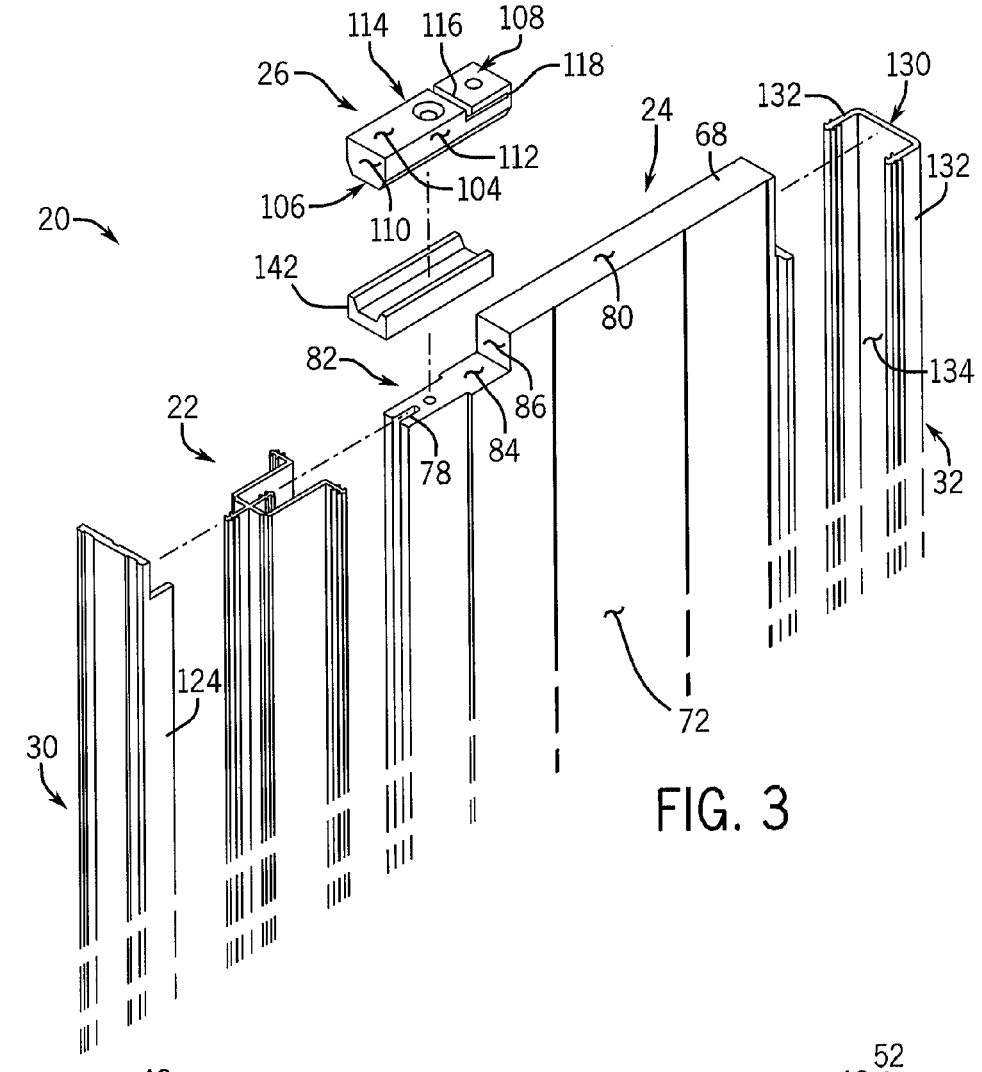
FIG. 3 is a exploded isometric view of mull components.

Referring to FIGS. 2 and 3, a mull assembly 20 includes an exterior mull binder 22, a center mull 24, a top mull cover 26, a bottom mull cover 28, a mull exterior trim 30 and a mull interior trim 32.

Figure 4:
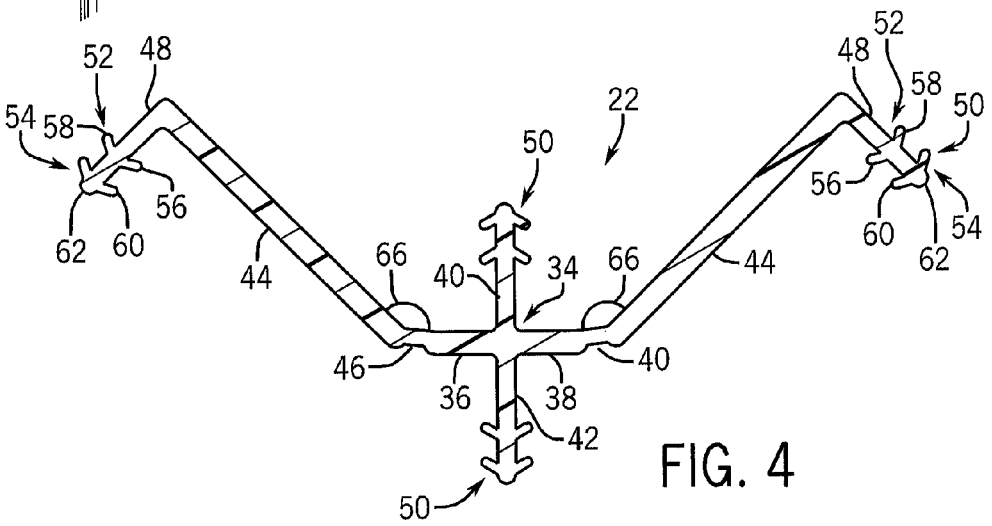
FIG. 4 is a cross sectional view of an exterior mull binder.

Referring to FIG. 4 exterior mull binder 22 includes a t-shaped base 34 having a first pair of arms 36, 38, an interior arm 40, and an exterior arm 42 extending perpendicular to the first pair of arms 36, 38. First arm 36 includes a first leg 44 being pivotally coupled thereto with a living hinge 46 and a second leg 48 extending perpendicular to the first leg 44. Living hinge 46 may be formed by providing a different more flexible material between base 34 and arms 36, 38 or may be formed by reducing the thickness of the material in the hinge so that arms 36 and 38 flex about hinge 46. Second leg 48 includes a plurality of barbs 50 extending from second leg 48 at an angle thereto. In one embodiment, barbs 50 include a first set of barbs 52 and a second set of barbs 54. Each set of barbs 52, 54 include a first barb 56 and a second barb 58. Barbs 50 extend the entire length of exterior mull binder 22.

In a preferred embodiment each barb 50 includes a base portion extending from leg 48 and a free end 60. In a relaxed non-flexed position each barb 50 forms an acute angle with second leg 48. Mull binder includes an upper surface 138 and a lower surface 140. In one embodiment barbs 50 extend the entire length from upper surface 138 to lower surface 140. However, it may be possible for barbs to either be intermittent or extend only a portion of the distance between upper surface 138 and lower surface 140.

Similarly, second arm 38 includes the same features as first arm 36. Each feature on second arm 38 is identified in the Figures with the same identifying numeral as the feature on first arm 36.

Interior arm 40 and exterior arm 42 extend perpendicular to arms 36 and 38. Each of interior arm 40 and exterior arm 42 include barbs 50 having a first and second pair of barbs 52, 54 and have similar geometry to barbs 50 described above extending from second arms 48. However, the barbs on interior arm 40 and exterior arm 42 may have other geometries as well.

In one embodiment arms 36, 38, 40 and 42, first leg 44, and second leg 48 are formed from a rigid PVC material. Living hinges 46 and barbs 50 are formed from a flexible PVC material that is more flexible than the rigid PVC material. Exterior mull binder 22 may be co-extruded using both the rigid PVC and flexible PVC to simultaneously form the rigid elements and flexible elements. According to various exemplary embodiments, barbs 50 may be made of flexible polyvinyl chloride (PVC), thermoplastic elastomer (TPE), flexible urethane, a rubber based material, or a similar flexible extruded material. According to various exemplary embodiments, arms 36, 38, 40 and 42, first leg 44, and second leg 48 may be made of PVC, polypropylene, acrylonitrile butadiene styrene (ABS), or any other rigid extrudable material.

Figure 5:
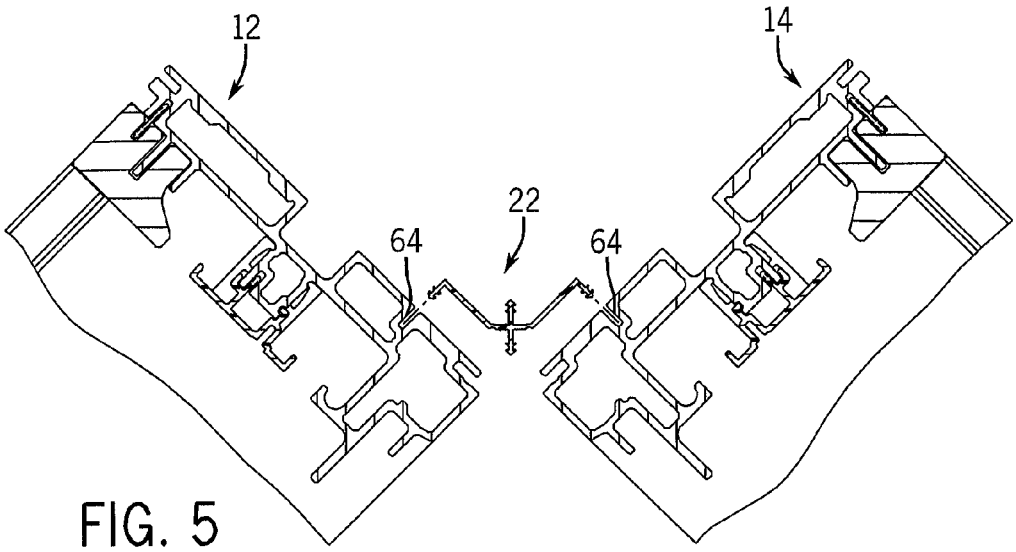
FIG. 5 is a cross sectional view illustrating the position of two window frames being mulled together in a first installation step.

Referring to FIG. 5 first frame 12 and second frame 14 each include a groove or kerf 64 that extends around the periphery of first frame 12. Kerf 64 is typically used to connect a fin to each window frame to secure the window frame to the exterior of a house or enclosure and generally includes a gut or groove in window frame which houses weather-stripping. In one embodiment kerf 64 measures three eighths inch deep by one eighth wide. In a non-flexed position the distance between the free ends 60 of first barb 56 and second barb 58 is greater than the width of the kerf 64. The distance between the free end 62 of second leg 48 and the free ends 60 of barbs 50 on the second set of barbs 54 in a vector direction taken a long the longitudinal axis of leg 48 is less than the depth of kerf 64. First frame 12 and second frame 14 are secured to one another by exterior mull binder 22. The free end 62 of second leg 48 of first arm 36 is inserted into kerf 64 on first frame 12. As second leg 48 is inserted into kerf 64 barbs 50 are deflected such that the free ends 60 are flexed toward second leg 48. Once second leg is fully inserted into kerf 64 both sets of barbs 52 and 54 are located within kerf 64. The spring force of barbs 50 force the free ends 60 against the walls of kerf 64. The result is that exterior mull binder 22 is secured to first frame 12 and forms a weather tight seal within kerf 64. Similarly, the free end 62 of second leg 48 of second arm 38 is inserted into kerf 64 on second frame 14. As a result, exterior mull binder 22 secures first frame 12 and second frame 14 together and also provides a weather right seal between the exterior and interior portions of the attached first and second frames.

Barbs 50 are flexible and have a spring force that biases them in an outward direction from second leg 48. When barbs 50 are inserted into kerf 64, barbs 50 are compressed between second leg 48 and the interior edge of kerf 64 and provide a force to the interior edges of kerf 64. The force provided by barbs 50 may be sufficient to couple first frame 12 and second frame 14 together and to provide a seal against air and/or moisture. The force required to remove barbs 50 of exterior mull binder 22 from kerf 64 of first frame 12 and second frame 14 is greater than the force required to insert barbs 50 into kerf. In one embodiment, no tools are needed to install or exterior mull binder 22 to first frame 12 and second frame 14 or to remove exterior mull binder 22 from first frame 12 and second frame 14. Barbs 50 provide sufficient force to connect first frame 12 and second frame 14 and provide a weather tight seal without the use of other adhesives or mechanical fasteners. It is also possible to remove exterior mull binder from kerf 64 by a person for maintenance and/or separation of first frame 12 and second frame 14.

Referring to FIG. 5 exterior mull binder 22 can be moved from a first position in which first legs 44 are at a first angle 66 that is obtuse with respect to first and second arms 36, 38 respectively to a second in use position in which first legs 44 are at a second angle that is less than first angle 66. In one embodiment second angle is ninety degrees.

Referring to FIGS. 2, and 3 center mull 24 includes a top side 68, an opposing bottom side 70, a right side 72, a left side 74, an exterior side 76 and an interior side 77. Top side 68 includes an upper surface 80 and a notch 82 having a lower surface 84. A notch side surface 86 extends from upper surface 80 to lower surface 84. Exterior side 76 includes a groove 78 extending from lower surface 84 of top side 68 to bottom side 70 of center mull.

Figure 6:
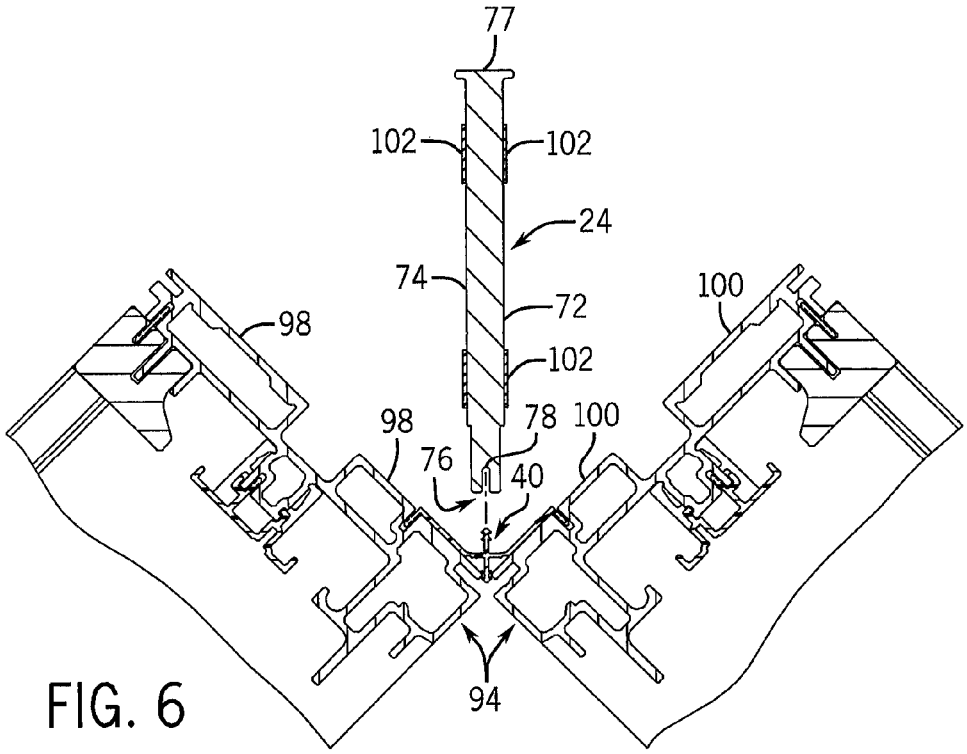
FIG. 6 is a cross sectional view illustrating the position of two window frames being mulled together in a step after the installation step of FIG. 5.

Referring to FIG. 6 first frame 12 includes a right side 98. Second frame 14 includes a left side 100. Center mull 24 is secured to first frame 12 and second frame 14. In one embodiment, groove 78 receives barbs 50 on arm 40 such that first and second sets of barbs 52, 54 of arm 40 is located within groove 78. Once barbs 50 are located within groove 78 center mull 24 is attached to exterior mull binder 22 and sealed thereto. Center mull 24 maybe further secured to first frame 12 and second frame 14 with a mechanical fastener or an adhesive. In one embodiment two sided tape 102 is secured to right side 72 and left side 74 of center mull 24. Two sided tape 102 is not a single element but represents all portions of two sided tape 102 that is used to secure the center mull 24 to the first frame 12 and second frame 14. In one embodiment there is a first two sided tape 102 on a left side of center mull 24 and a second two sided tape 102 on the opposing right side of center mull 24.

Figure 8:
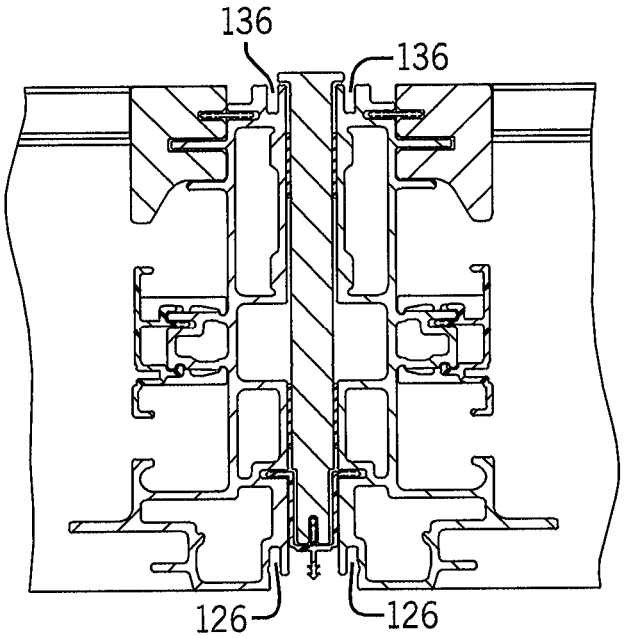
FIG. 8 is a cross sectional view illustrating the position of two window frames being mulled together after the installation step of FIG. 7.

Referring to FIGS. 1, 2 and 8 first frame 12 and second frame 14 each include a top side 90, a bottom side 92, an exterior side 94, an interior side 96, a right side 98 and a left side 100. Kerf 64 extends about top side 90, bottom side 92, right side 98 and left side 100 of each frame 12, 14. As discussed above exterior mull binder 22 is secured to kerf 64 in the right side 98 of frame 12 and left side 100 of frame 14.

Figure 7:
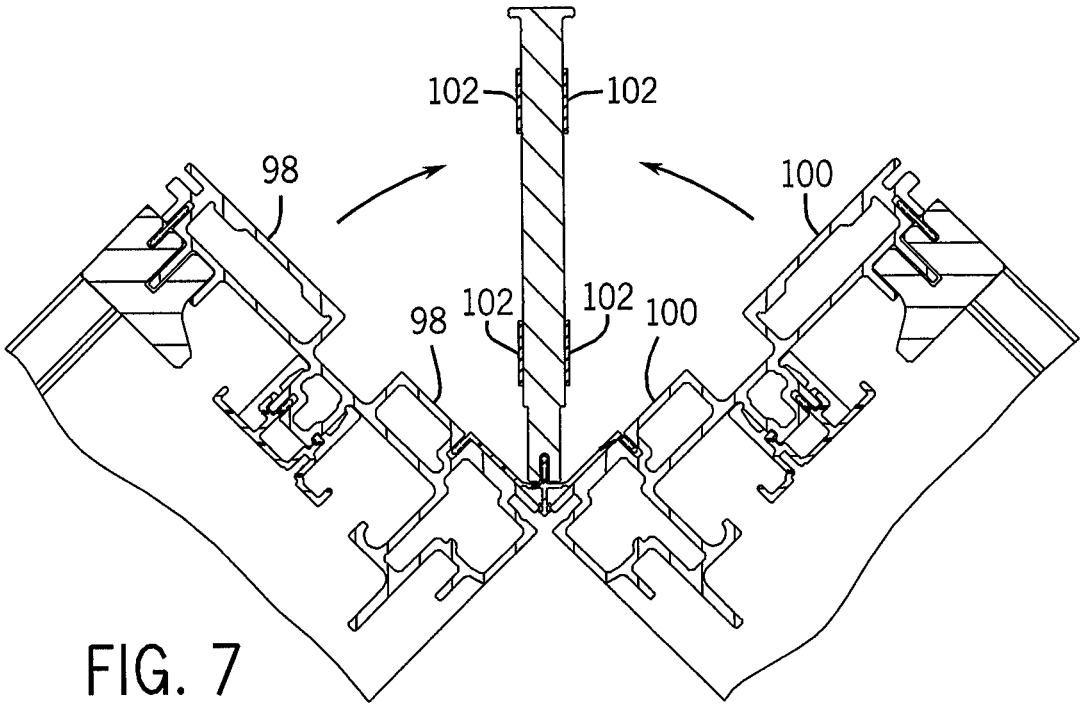
FIG. 7 is a cross sectional view illustrating the position of two window frames being mulled together in a in a step after the installation step of FIG. 6.

Referring to FIG. 7 first frame 12 and second frame 14 secured to exterior mull binder 22 are moved toward each other about living hinges 46 of exterior mull binder 22. First frame 12 and second frame 14 continue to pivot toward each other until right side 98 of first frame contacts the two sided tape 102 on the left side 74 of center mull 24 and left side 100 of second frame 14 contacts the two sided tape 102 on the right side 72 of center mull 24. Once center mull 24 is adhesively secured to first frame 12 and second frame 14 legs 44 of first and second arms 36 and 38 are parallel to one another.

Figure 9:
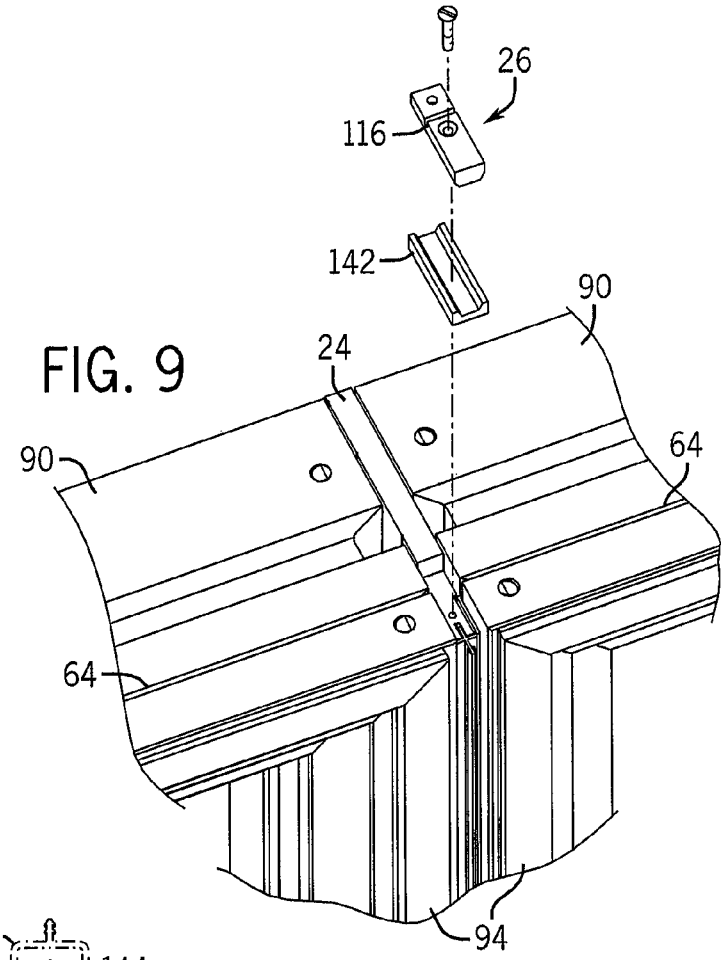
FIG. 9 is an isometric view of a mull and the window frames after the installation step of FIG. 8

Referring to FIG. 9 top mull cover 26 is secured to center mull 24. Top mull cover has a top surface 104, an opposing bottom surface 106, an interior surface 108, an exterior surface 110, a right side 112 and a left side 114. A first groove 116 extends from top surface 104 toward bottom surface 106 and perpendicular to the right side 112 and left side 114. A second groove 118 extends from a terminal end of first groove 116 toward the interior surface, the first groove and second groove form a continues L-shaped channel. Mull top cover is located in notch 82 such that bottom surface 106 is adjacent lower surface 84 of center mull 24. First groove 116 is aligned with kerf 64 on the top side 90 of first frame 12 and second frame 14. A sealant may be inserted into first groove 116 and second groove 118 through first groove 116 to further provide a weather tight seal between first frame 12 and second frame 14. Bottom mull cover 28 has similar features to that of top mull cover 26 and is secured to a notch on the bottom 70 of center mull 24. A sealant is inserted into the grooves of the bottom mull cover in a similar manner as discussed above with respect to top mull cover 26.

Figure 10:
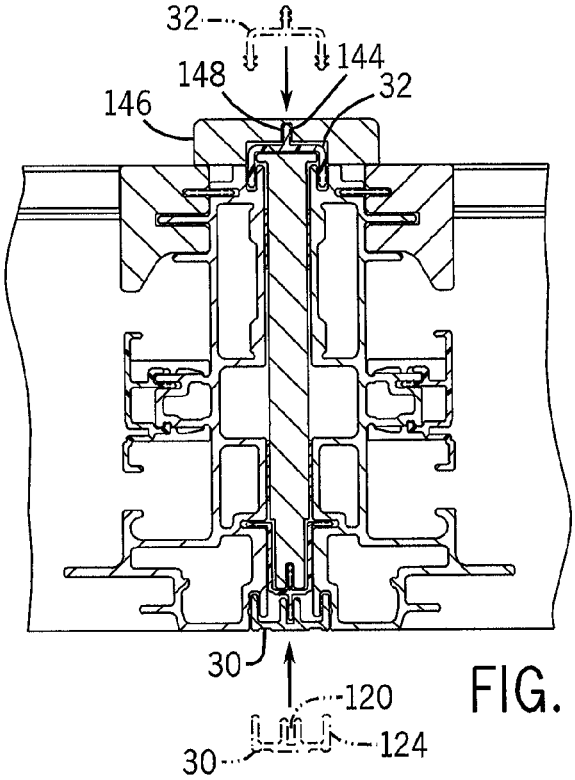
FIG. 10 is a cross sectional view of two window frames being mulled with an exterior and interior mull trim.

Referring to FIGS. 3, 8 and 10 mull exterior trim 30 includes a groove 120 having an opening accessible from an interior side 122. Groove 120 receives barbs 50 on exterior arm 42 of exterior mull binder 22. Mull exterior trim 30 includes two extensions 124 that are received within a groove 126 located in each of first frame 12 and second frame 14. Mull exterior trim 30 includes an exterior side 128 that may have a decorative or weather resistant coating for exposure to the outdoors. Mull interior trim 32 includes an interior side 130 and two extensions 132 extending from an exterior side 134 away from interior side 130. Each extension 132 includes a barbs 50 as described above with respect to exterior mull binder 22. First frame 12 includes a groove 136 and second frame 14 includes a groove 136 that receive barbs 50 on extensions 132 as described above with respect to exterior mull binder 22. In this manner mull interior trim 32 is secured to first frame 12 and second frame 14 providing a weather tight seal. Interior side 130 may be a decorative material for viewing in the interior of a closure such as a building. In an alternative embodiment, mull interior trim 32 includes a third extension 144 extending from interior surface 130 in a direction away from exterior surface 134. A decorative member 146 includes a groove 148 that receives a plurality of barbs 50 extending from third extension 144. In this way additional an additional seal point is created and the opportunity for further decorative member 146 to be secured.

Referring to FIGS. 2, 3 and 9 a seal 142 formed from a close cell foam material may be positioned between lower surface 84 of notch 82 and top mull cover 26 to increase the seal between first frame 12, second frame 14, exterior mull binder 22 and center mull 24. Similarly, a seal 142 may also be located between bottom lower mull cover 28 and the notch in bottom side 70 of center mull 24. A screw or other mechanical fastener extends through an aperture in top mull cover 26 to secure top mull cover 26 and further ensure a weather tight seal between first frame 12 and second frame 14. In one embodiment a nail fin maybe inserted into kerf 64 on top surface 90 of first frame 12 and second frame 14 as well as groove 116 to provide a continuous seal. Referring to FIGS. 2, 3 and 9, seal 142 covers and upper surface 138 of exterior mull binder 22 providing a seal on the upper side of exterior mull binder 22. Similarly, a lower seal 142 secured by lower mull cover 28 covers lower surface 140 providing a seal on the lower edge of exterior mull binder 22.

The assembly procedure for securing first frame 12 and second frame 14 will now be reviewed. Referring to FIG. 5 first frame 12 and second frame 14 are set an angle relative to one another, such that the interior side of first frame 12 and interior second frame 14 are not in the same plane. This position allows barbs 50 of legs 48 of first arm 36 and second arm 38 of exterior mull binder 22 to be inserted in kerf 64 of first frame 12 and second frame 14 along the entire length of the first frame 12 and second frame 14 between top side 90 and bottom side 92. In one embodiment exterior mull binder 22 extends almost the entire distance between the top side 90 and bottom side 92 of first and second frames 12, 14. Referring to FIG. 9 the upper surface 138 of exterior mull binder 22 is a set distance below top side 90 of first frame 12 and second frame 14 to permit insertion of top mull cover 26. Barbs 50 extend from an upper surface 138 to the lower surface 140 of exterior mull binder 22 providing a weather tight seal along the entire length of kerf 64. The rigid PVC sections of exterior mull binder 22 provide support connecting first frame 12 and second frame 14 together. The flexible PVC hinge 46 of exterior mull binder 22 allows the first frame 12 and second frame 14 to be moved from the first installation position to a second in-use position.

Prior to pivoting first frame 12 and second frame 14 center mull 24 is placed in between right side 98 of first frame and left side 100 of second frame. Two sided tape 102 is applied to the right side and left side 74 left of mull center 24. Either before or after application of two sided tape 102, mull center 24 is secured to exterior mull binder 22 by placing groove 78 onto barbs 50 of interior arm 40. Referring to FIGS. 6 and 7 once mull binder 22 has been secured to the interior arm 40 via barbs 50 first frame 12 and second frame 14 are moved toward one another by pivoting hinges 46 until right side 98 of first frame 12 contacts the two sided tape 102 on the left side 74 of center mull 24 and left side 100 of second frame 14 contacts the two sided tape 102 on the right side 72 of center mull 24. Center mull provides additional support and strength to the connected first frame 12 and second frame 14.

Referring to FIG. 9 top mull cover 26 is positioned within notch 82 and secured to center mull 24 with a screw or other mechanical fastener. Top mull cover 26 is aligned such that groove 116 is co-linear with kerf 64 on top side 90 of first frame 12 and second frame 14. A sealant is applied to groove 116 to provide a weather tight seal along top side 90 of the first frame 12 and second frame 14. Bottom mull 28 is similarly positioned within a notch on the bottom side of center mull 24 such that a weather tight seal is provided along bottom side 92 of first frame 12 and second frame 14. Sealant extends into groove 116 and out the sides of grooves 116 and 118 to seal the region between kerfs 64 on the top sides of first frame 12 and second frame 14. In this way the seam between the first frame 12 and second frame 14 is sealed in a weather tight manner to prohibit moisture and air from moving between the coupled first frame 12 and second frame 14.

Referring to FIGS. 8 and 10, mull exterior trim 30 and mull interior trim 32 are coupled to first frame 12 and second frame 14. Mull exterior trim 30 is coupled to first frame and second frame 14 by inserting exterior arm 42 of exterior mull binder 22 into groove 120 of the mull exterior trim 32. The free ends of barbs 50 on exterior arm 42 are flexed inward toward the longitudinal axis of exterior arm 42 as exterior arm 42 is received in grove 120. The free ends of barbs 50 provide a force against the interior surface of grove 120 both coupling the exterior mull trim 30 and exterior mull binder 22 together but providing a seal between mull trim 30 and exterior mull binder 22. Additionally, extensions 124 of mull exterior trim 30 are received within grooves 126 of first frame 12 and second frame 14. Extension 124 may also include barbs 50 that would be received within grooves 126 providing a further coupling and seal. Mull Interior trim 32 is coupled to center mull 24 and first frame 12 and second frame 14 by inserting extensions 132 into grooves 136 of first frame 12 and second frame 14. Extensions 132 include flexible barbs 50 and operate in a similar manner to the barbs noted above to couple mull interior trim to first frame 12 and second frame 14 and provide a weather tight seal between the first frame 12 and second frame 14. Grooves 126 and 136 in first and second frames extend substantially the entire length of the frames between the top side 90 and bottom side 92. Similarly, barbs 50 extend substantially the entire distance between the top side 90 and bottom side 92 as well. In an exemplary embodiment barbs 50 of each of the arms of the mull exterior binder operate in a similar manner. It is possible that barbs 50 may have different features and or geometry on the different arms of the mull exterior binder.

For purposes of this disclosure, the term "coupled" means the joining of two components directly or indirectly to one another. Such joining may be stationary in nature or movable in nature. Such joining may be achieved with the two components (electrical or mechanical) and any additional intermediate members being integrally defined as a single unitary body with one another or with the two components or the two components and any additional member being attached to one another. Such joining may be permanent in nature or alternatively may be removable or releasable in nature.

The present disclosure has been described with reference to exemplary embodiments, however, workers skilled in the art will recognize that changes may be made in form and detail without departing from the spirit and scope of the disclosure. For example, although different example embodiments may have been described as including one or more features providing one or more benefits, it is contemplated that the described features may be interchanged with one another or alternatively be combined with one another in the described example embodiments or in other alternative embodiments. Because the technology of the present disclosure is relatively complex, not all changes in the technology are foreseeable. The present disclosure described with reference to the example is manifestly intended to be as broad as possible. For example, unless specifically otherwise noted a single particular element may also encompass a plurality of such particular elements. In one example window frames 12 and 14 have four sides, but it is contemplated that windows with three sides or with five or more sides could be mulled using the features discussed herein. It is also contemplated that windows may be mulled together along a top of one window frame and a bottom of another window frame. It is also contemplated that more than two windows can be mulled together.

It is also important to note that the construction and arrangement of the elements of the system as shown in the exemplary embodiments is illustrative only. Although only a certain number of embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited.

Further, elements shown as integrally formed may be constructed of multiple parts or elements shown as multiple parts may be integrally formed, the operation of the assemblies may be reversed or otherwise varied, the length or width of the structures and/or members or connectors or other elements of the system may be varied, the nature or number of adjustment or attachment positions provided between the elements may be varied. It should be noted that the elements and/or assemblies of the system may be constructed from any of a wide variety of materials that provide sufficient strength or durability. Accordingly, all such modifications are intended to be included within the scope of the present disclosure. Other substitutions, modifications, changes and omissions may be made in the design, operating conditions and arrangement of the exemplary embodiments without departing from the spirit of the present subject matter.

What is claimed is:

1. A mull binder for coupling a first window frame and a second window frame comprising:

a mull binder having a first arm and a second arm, the first arm being coupled to the second arm, the first arm being movable relative to the second arm from a first installation position to a second in-use position, the first and second arms including a plurality of flexible barbs configured to be received within a groove of the first window frame and the second window frame respectively, the mull binder coupling the first window frame and the second window frame together and providing a seal between the first window frame and the second window frame, the first window frame being movable relative to the second window frame after the first arm is coupled to the first window frame and the second arm is coupled to the second window frame, where the first window frame and the second window frame are not parallel to one another in the first installation position and the first window frame and the second window frame being parallel to one another in the second in-use position;

wherein the mull binder includes a base and the first arm and the second arm are pivotally coupled to the base with a living hinge, each arm having an L-shape with a first leg portion and a second leg portion, the plurality of barbs extending from the second leg portion, the first leg portion and second leg portion are formed of a first material being more rigid than the living hinges and the flexible barbs;

wherein the barbs extend from the second leg portion and include a first pair of barbs proximate a terminal end of the second leg portion and a second pair of barbs extending from the second leg portion at a location between the first pair of barbs and the first leg portion, each barb of the first pair of barbs and second pair of barbs extend from opposite sides of the second leg portion.

2. A mull binder system, comprising:

a first window frame having a top side, a bottom side, a right side, a left side, an exterior side and an interior side, the right side including a groove therein and extending a majority of a distance between the top side and bottom side, the groove having a longitudinal axis perpendicular to the top side and bottom side and substantially parallel to the exterior and interior sides;

a second window frame having a top side, a bottom side, a right side, a left side, an exterior side and an interior side, the left side including a groove therein and extending the majority of the distance between the top side and bottom side, the groove having a longitudinal axis perpendicular to the top side and bottom side and substantially parallel to the exterior and interior sides;

an exterior mull binder having a first arm and a second arm coupled thereto, the first arm being received within the groove of the first window frame, the second arm being received within the groove of the second window frame coupling the first window frame to the second window frame;

a center mull secured to the right side of the first window frame and to the left side of the second window frame, the center mull including an upper surface having a notch extending therein proximate an exterior surface of the center mull; and a mull seal cap being secured to the upper surface of the center mull, the mull seal cap includes an upper surface, a lower surface, a first side extending between the upper and lower surfaces and a second side extending between the upper and lower surfaces, an interior surface and an opposing exterior surface perpendicular to both the upper surface and first side, the upper surface including a first groove extending therein toward the lower surface and perpendicular to the first and second sides of the mull seal cap.

3. The mull binder system of claim 2, wherein the first arm and second arm are pivotally coupled to the exterior mull binder with a living hinge permitting the first window frame and second window frame to pivot from a first position to a second position when coupled to the exterior mull binder.

4. The mull bunder system of claim 3, the center mull including a groove extending substantially an entire length of a first end of the center mull, the exterior mull binder including a third arm having a plurality of flexible barbs extending therefrom received within the center mull groove to couple and seal the center mull to the exterior mull binder and first and second window frames.

5. The mull binder system of claim 2, wherein the first groove in the mull seal cap is connected to a second groove within the mull seal cap extending from a terminal end of the first groove toward the interior surface of the mull seal cap, the first groove and second groove form a continuous L-shaped groove configured to receive a sealant material.

6. The mull binder system of claim 5, wherein the first groove is aligned with a groove on the top side of the first window frame and a groove on the top side of the second window frame.

7. The mull binder system of claim 6, wherein the center mull is adhesively secured to the right side of the first window frame and to the left side of the second window frame.

8. The mull binder system of claim 2, wherein the first window frame includes a top surface having the groove therein extending between the right and left sides of the first window frame, and the second window frame includes a top surface having the groove therein extending between the right and left sides of the second window frame, the groove of each of the first window frame and the second window frame configured to receive a nail fin.

9. The mull binder system of claim 8, wherein the exterior mull binder includes an upper surface and a lower surface, the upper surface being below the top surface of the first window frame and the top surface of the second window frame.

10. A mull binder system comprising:

a first window frame having a top surface, an exterior side, an opposing interior side and at least a first side and a second side extending perpendicular to the exterior side and interior side, the first side including a groove therein and the top surface including a groove therein extending between the first and second sides;

a second window frame having a top surface, an exterior side, an opposing interior side and a first side and a second side extending perpendicular to the exterior side and interior side, the second side including a groove therein and the top surface including a groove therein extending between the first and second sides;

an exterior mull binder having a first and second arm coupled thereto, each arm having a plurality of flexible barbs extending therefrom, the barbs on the first arm being received within the groove of the first window frame, the barbs on the second arm being received within the groove of the second window frame coupling the first window frame to the second window frame and providing a seal along the grooves of each of the first window frame and the second window frame, the exterior side of the first window frame and the exterior side of the second window frame being substantially co-planar;

a top mull cover being located above the exterior mull binder, the top mull cover having a groove extending therethrough and being coplanar with the groove extending in the top surface of the first window frame and the groove extending in the top surface of the second window frame;

wherein the flexible barbs on the first arm are inserted into the groove of the first window frame and the flexible barbs on the second arm are inserted into the groove of the second window frame when the exterior sides of the first window frame and second window frame are not co-planar, the first window frame being movable relative to the second window frame to a second position where the exterior sides of the first window frame and second window frame are co-planar.

11. The mull binder system of claim 10, wherein the first arm is formed of a material that is more rigid than the barbs.

12. The mull binder system of claim 11, wherein the first and second arms are pivotally coupled to the exterior mull binder with a living hinge.

13. The mull binder system of claim 12, wherein the living hinge is formed of a material more flexible than the material of the first arm, the living hinge being co-extruded with the arms and barbs.

14. The mull binder system of claim 13, wherein the groove on the first side of the first window frame including interior edges, the flexible barbs being compressed when the first arm is inserted into the groove on the first side of the first window frame, the flexible barbs providing a force on the interior edges of the groove to couple the exterior mull binder to the first window frame and provide a seal along the groove.

15. The mull binder system of claim 14, wherein the exterior mull binder including a base, the living hinge of each arm being connected to the base, each arm having a first leg and a second leg extending perpendicular from the first leg.

16. A mull binder system, comprising:

a first window frame having a top side, a bottom side, a right side, a left side, an exterior side and an interior side, the right side including a groove therein and extending a majority of a distance between the top side and bottom side, the groove having a longitudinal axis perpendicular to the top side and bottom side and substantially parallel to the exterior and interior sides;

a second window frame having a top side, a bottom side, a right side, a left side, an exterior side and an interior side, the left side including a groove therein and extending the majority of the distance between the top side and bottom side, the groove having a longitudinal axis perpendicular to the top side and bottom side and substantially parallel to the exterior and interior sides; and an exterior mull binder having a first and second arm coupled thereto, each arm having a plurality of flexible barbs extending therefrom, the barbs on the first arm being received within the groove of the first window frame, the barbs on the second arm being received within the groove of the second window frame coupling the first window frame to the second window frame and providing a weather tight seal along the grooves of the first window frame and the second window frame;

a center mull being secured to the right side of the first window frame and to the left side of the second window frame;

the first window frame including a top surface having the groove therein extending between the right and left sides of the first window frame, and the second window frame includes a top surface having the groove therein extending between the right and left sides of the second window frame, the groove on the top surface of each of the first window frame and second window frame configured to receive a nail fin;

the exterior mull binder including a base, the living hinge of each arm being connected to the base, each arm having a first leg and a second leg extending perpendicular from the first leg; and a top mull cover being secured to the exterior mull binder, the top mull cover having a groove extending therethrough and being coplanar with the groove extending in the top surface of the first window frame and the groove extending in the top surface of the second window frame.

17. The mull binder system of claim 16 wherein the top mull cover includes a seal located between the top mull cover and an upper surface of the exterior mull binder.

18. The mull binder system of claim 17, wherein the upper surface of the exterior mull binder is below the top surface of the first window frame and the top surface of the second window frame.

19. A mull binder system comprising:

a first window frame having an exterior side, an opposing interior side and at least a first side and a second side extending perpendicular to the exterior side and interior side, the first side including a groove therein;

a second window frame having an exterior side, an opposing interior side and a first side and a second side extending perpendicular to the exterior side and interior side, the second side including a groove therein;

a mull binder having a first and second arm coupled thereto, each arm having a plurality of flexible barbs extending therefrom, the barbs on the first arm being received within the groove of the first window frame, the barbs on the second arm being received within the groove of the second window frame coupling the first window frame to the second window frame and providing a seal along the grooves of each of the first window frame and the second window frame, the exterior side of the first window frame and the exterior side of the second window frame being substantially co-planar;

the flexible barbs on the first arm are inserted into the groove of the first window frame and the flexible barbs on the second arm are inserted into the groove of the second window frame when the exterior sides of the first window frame and second window frame are not co-planar, the first window frame being movable relative to the second window frame to a second position where the exterior sides of the first window frame and the second window frames are co-planar;

the first arm being formed of a material that is more rigid than the barbs;

the first and second arms being pivotally coupled to the mull binder with a living hinge;

the living hinge is formed of a material more flexible than the material of the first arm, the living hinge being co-extruded with the arms and barbs;

the groove of the first window frame including interior edges, the flexible barbs being compressed when the first arm is inserted into the groove on the first side of the first window frame, the flexible barbs providing a force on the interior edges of the groove on the first side of the first window frame to couple the exterior mull binder to the first window frame and provide a seal along the groove on the first side of the first window frame;

the mull binder including a base, the living hinge of each arm being connected to the base, each arm having a first leg and a second leg extending perpendicular from the first leg; and wherein the barbs extend from the second leg and include a first pair of barbs proximate a terminal end of the second leg and a second pair of barbs extending from a portion of the second leg between the first pair of barbs and the first leg, each barb of the first pair of barbs and second pair of barbs extend from opposite sides of the second leg.

20. The mull binder system of claim 19, wherein each barb includes a base end extending from the second leg and a free end extending in a vector direction toward the first leg, an angle formed between the second leg and each barb is an acute angle, each barb extending a length substantially equal to a length of the groove on the first side of the first window frame that receives the barb.

* * * * *